United States Patent [19]

Fox

[11] 4,042,023

[45] Aug. 16, 1977

[54] CONTROL LINE PROTECTOR

[75] Inventor: Roy Kelvin Noel Fox, Great Yarmouth, England

[73] Assignee: Weatherford Oil Tool Co., Inc., Houston, Tex.

[21] Appl. No.: 610,066

[22] Filed: Sept. 3, 1975

[30] Foreign Application Priority Data

Sept. 12, 1974 United Kingdom ..... 39784/74

[51] Int. Cl.[2] ..... E21B 17/10

[52] U.S. Cl. ..... 166/241; 308/4 A

[58] Field of Search ..... 308/4 A; 166/241, 106, 166/189, 72; 285/137 R; 174/47; 175/325

[56] References Cited

U.S. PATENT DOCUMENTS

| | | | |
|---|---|---|---|
| 3,734,179 | 5/1973 | Smedley | 166/106 |
| 3,740,801 | 6/1973 | Sears, Jr. et al. | 285/137 R |
| 3,844,345 | 10/1974 | Evans et al. | 166/72 |
| 3,893,778 | 7/1975 | Williams | 308/4 A |
| 3,894,780 | 7/1975 | Broussard | 308/4 A |
| 3,899,631 | 8/1975 | Clark | 174/47 |
| 3,933,203 | 1/1976 | Evans | 166/241 |

FOREIGN PATENT DOCUMENTS

| | | | |
|---|---|---|---|
| 524,909 | 5/1956 | Canada | 174/47 |

*Primary Examiner*—Ernest R. Purser
*Assistant Examiner*—William F. Pate, III
*Attorney, Agent, or Firm*—Fulbright & Jaworski

[57] ABSTRACT

A positioning device, for insertion in the annular space between an oil well lining pipe and an oil or gas flow tubing therein, is seated about the flow tubing and includes a resiliently deformable portion having a recess which opens at an external face to permit a control line tube to be forced into the recess, by resilient deformation, and be held in a predetermined position in the annular space. A preferred device is openable or in separable sections and is lockable on the flow tubing by taper pin. The device may have plural recesses, which may be of different sizes, and may be adapted to receive plural flow tubings.

9 Claims, 16 Drawing Figures

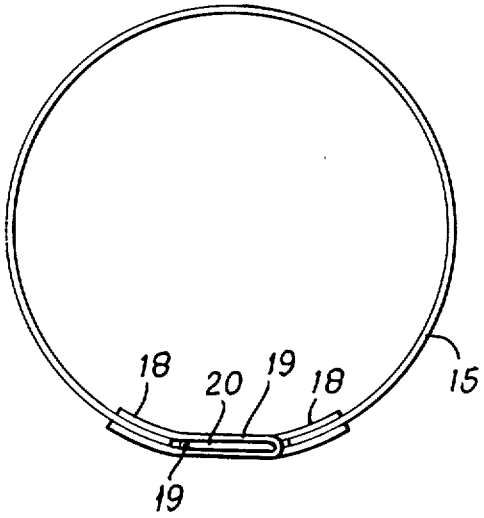
FIG. 6
FIG. 8 FIG. 7
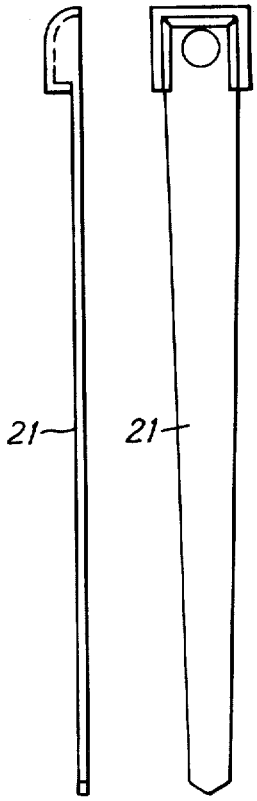
FIG. 5
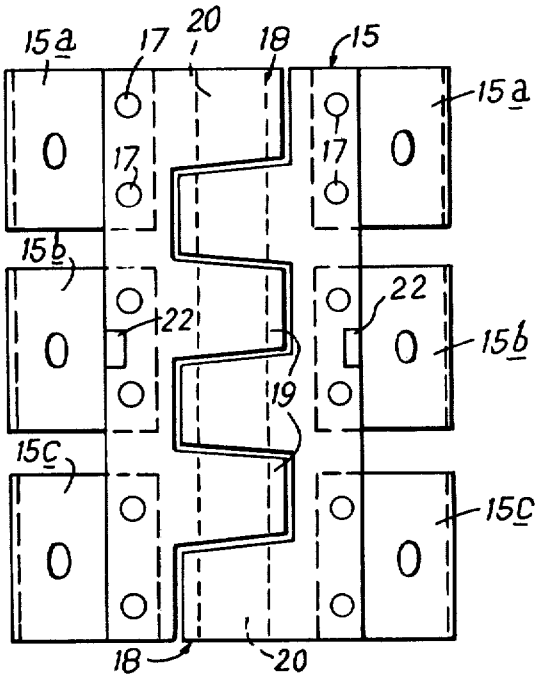

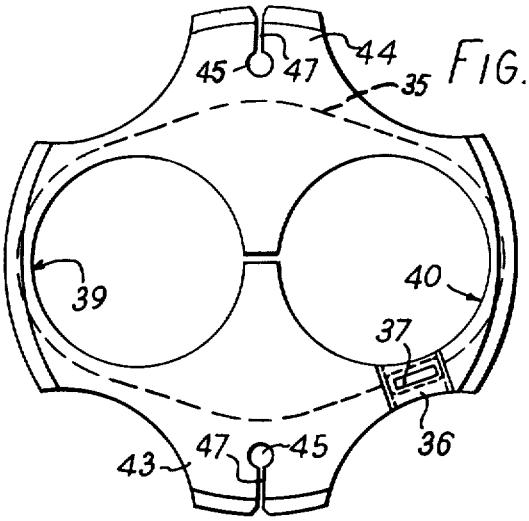
FIG. 13
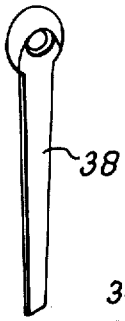
FIG. 15
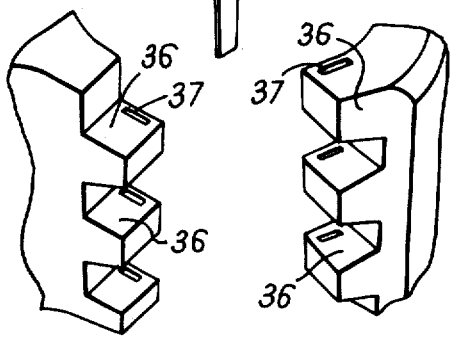
FIG. 16
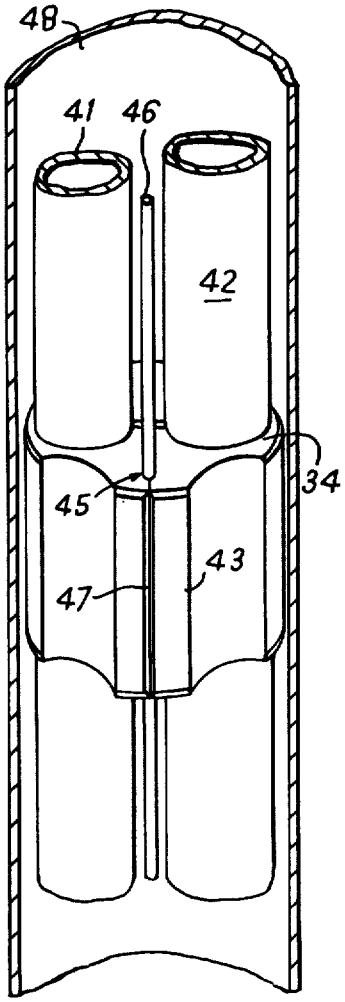
FIG. 14
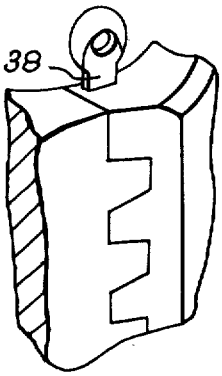

CONTROL LINE PROTECTOR

Oil wells, and particularly most offshore producing oil wells, have equipment such as a safety control valve installed in the tubing and automatically activated in the event of problems with surface equipment which would otherwise result in a blowout.

This in-tube equipment is activated hydraulically from the surface and the hydraulic power is transmitted from the surface to the equipment by means of a hydraulic control line (tube) which is positioned in an annular space between a lining pipe cemented in the well and the flow tubing through which the oil or gas is produced.

The control line is in a vulnerable position in the annular space and is subject to damage by crushing between the pipe and the tubing.

It is already known in this art to provide positioning devices, for placing in the annular space, for holding hydraulic control lines in a predetermined position spaced from the pipe and from the tubing, but in all constructions devised hitherto the devices have had to be applied axially over the control line, and such an arrangement is inconvenient and ineffective.

Certain design criteria are desirable, e.g. (i) the positioning device should be easily installed, (ii) it should grip the flow tubing sufficiently to prevent the device from moving laterally along the flow tubing even when being run into deviated well-bores, (iii) the device should not mark or score the surface of the flow tubing, because this would create a corrosion hazard under certain oil well conditions, (iv) it should be possible to preinstal the positioning device on the flow tubing before the lengths of flow tubing are screwed together, thereby saving rig time, and (v) above all, the control line should be held firmly in position and well protected.

It is the object of this invention to provide an improved construction of positioning device which fulfills the above criteria.

According to the present invention a positioning device, for insertion in a space between a well lining pipe and a flow tubing therein for positioning in said space a control line tube, comprises a body adapted to seat about the flow tubing, said body having an internal face to abut against the flow tubing and an external face remote from the internal face, said body including a resiliently deformable portion having a recess which opens at said external face and is adapted to receive a control line tube by resilient deformation of said portion. For example, the recess may include an opening in which the control line tube can be seated, and a passage communicating with said opening and with said external face, said passage being, for at least part of its length, of a width less than the width of said opening.

With such a construction, when the device is engaged on the flow tubing, the control line tube can be introduced from the exterior and forced into the recess, to be firmly retained therein, the dimensions of the recess being suitably selected in accordance with the width of the control line tube.

In a preferred form, the body comprises a metal cage and a covering of resiliently deformable material about said cage.

The body may include a plurality of spaced bores to receive respective flow tubings, and may also have a plurality of openings to receive respective control line tubes, and at least one of said recesses may advantageously be adapted to receive a control line tube of a first width, and at least another of said recesses adapted to receive a control line tube of a different width.

In a first manner of construction the body may have a break in circumferential continuity, with locking means provided for securing the circumferential ends together. In a second manner of construction, the body may have a plurality of circumferentially separate parts, with locking means provided for securing together the adjacent ends of neighbouring circumferential parts. Such locking means, for either manner of construction, may comprise slots in the circumferential ends of the body, or of the circumferential parts of the body, as the case may be, and a taper pin for engagement in said slots, thereby to permit securing of the body on flow tubings of different diameters, within limits. In a preferred construction, the circumferential ends of the body or of the circumferential parts of the body, as the case may be, have axially spaced fingers, the fingers of one such end being interspersed between the fingers of the other such end, said slots being formed in said fingers.

Some embodiments, of positioning device in accordance with the invention are hereinafter particularly described with reference to the accompanying drawings wherein:

FIG. 5 is a side elevation of a metal cage incorporated in the device of FIG. 3;

FIG. 6 is a plan view of the metal cage of FIG. 5;

FIG. 7 is a front elevation of a metal taper locking pin forming part of the device of FIG. 3;

FIG. 8 is a side elevation of the pin of FIG. 7;

FIG. 13 is a plan view of a fourth embodiment of positioning device, for use on plural flow tubings;

FIG. 14 is a perspective elevation, viewed from the side and above, of the device of FIG. 13, shown installed on two flow tubings within a well pipe;

FIG. 15 is a partial perspective elevation to show locking means prior to locking engagement;

FIG. 16 is a partial perspective elevation showing the locking means of FIG. 15 after locking engagement.

Figure 1:
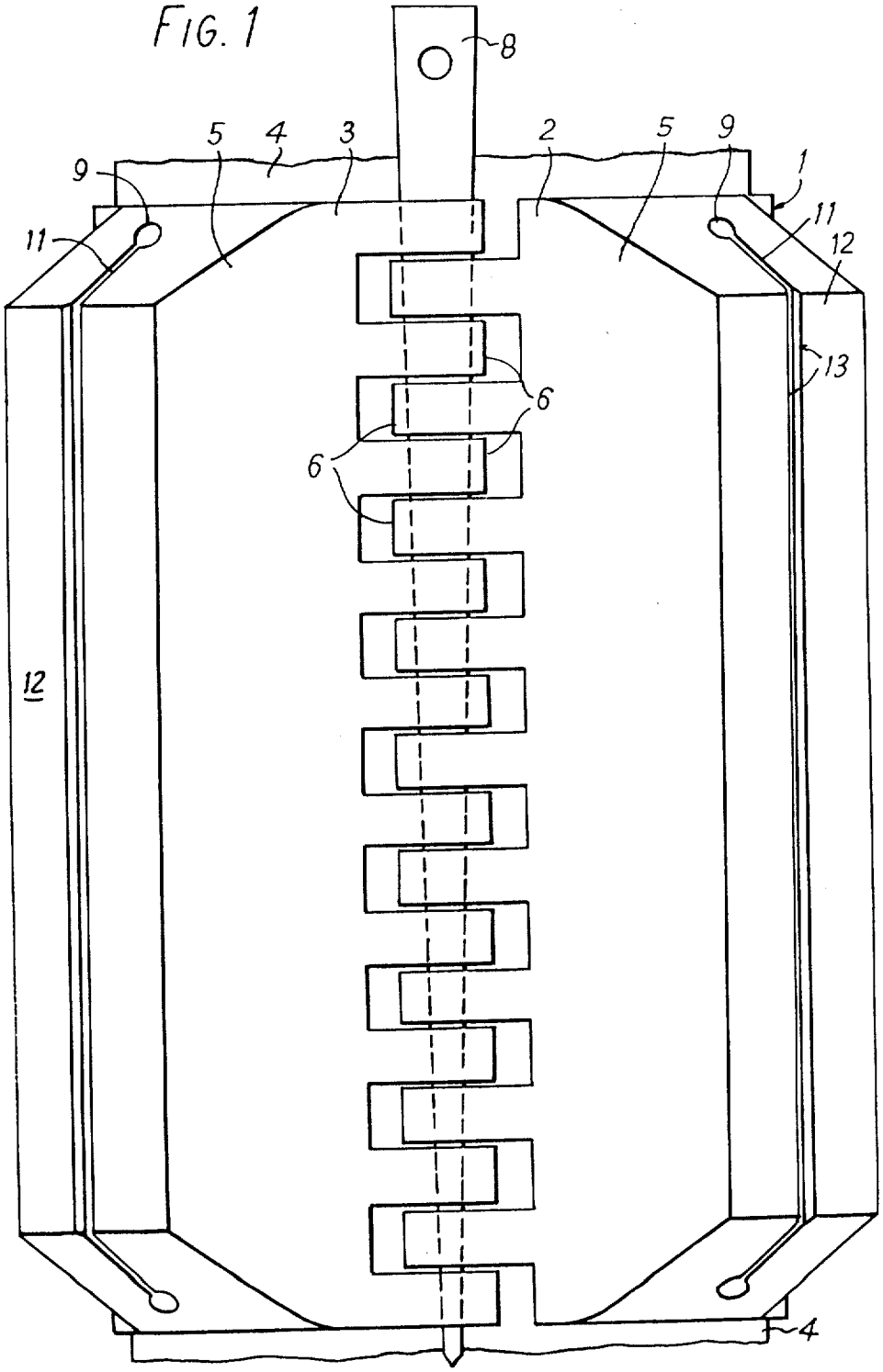
FIG. 1 is a side elevation of a first embodiment of positioning device, in assembled condition and installed on a flow tubing.
Figure 2:
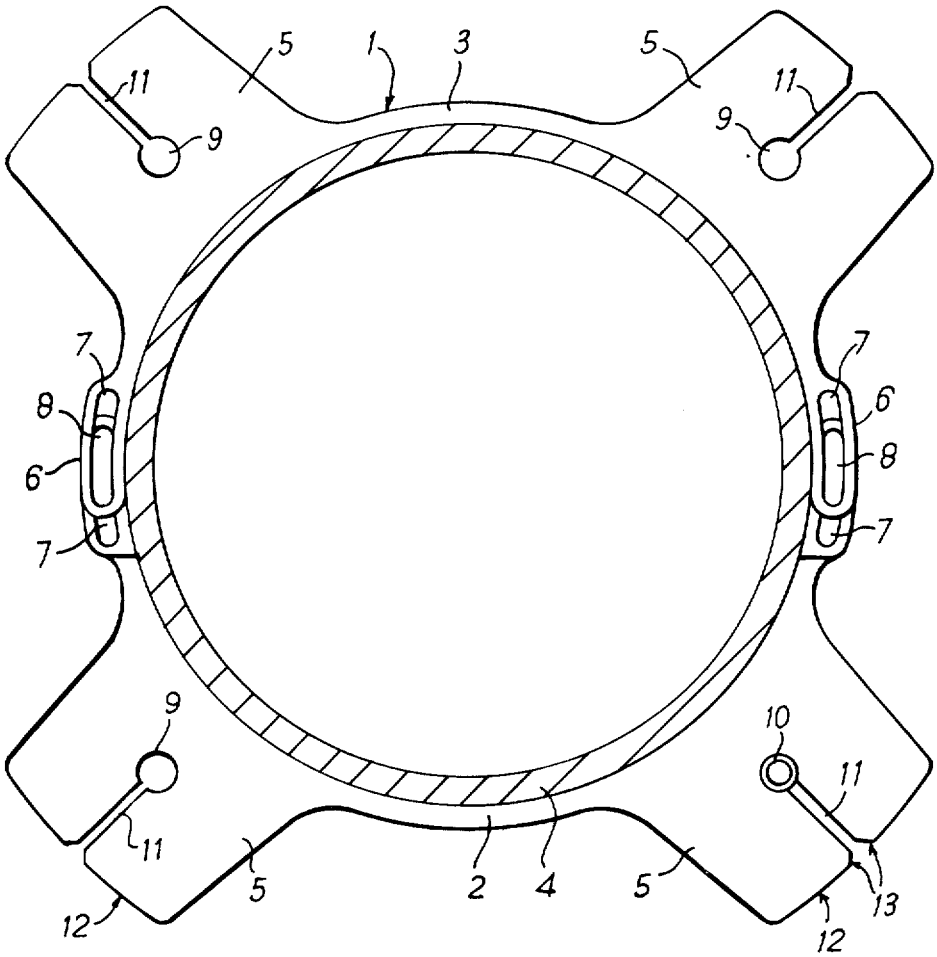
FIG. 2 is a plan view of the device of FIG. 1, installed on the flow tubing.
Figure 3:
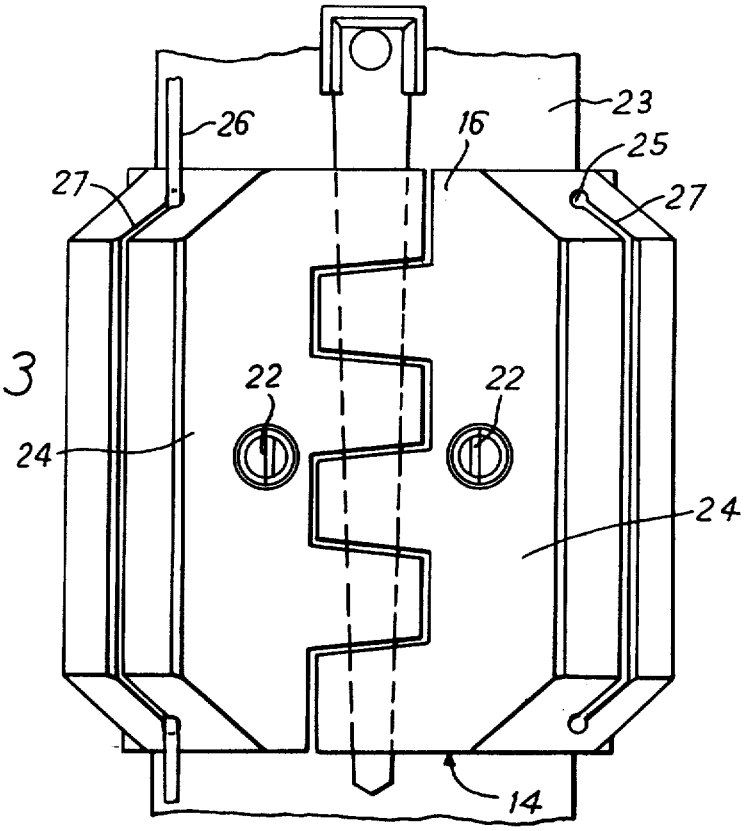
FIG. 3 is a side elevation of a second embodiment of positioning device, installed on a flow tubing.
Figure 4:
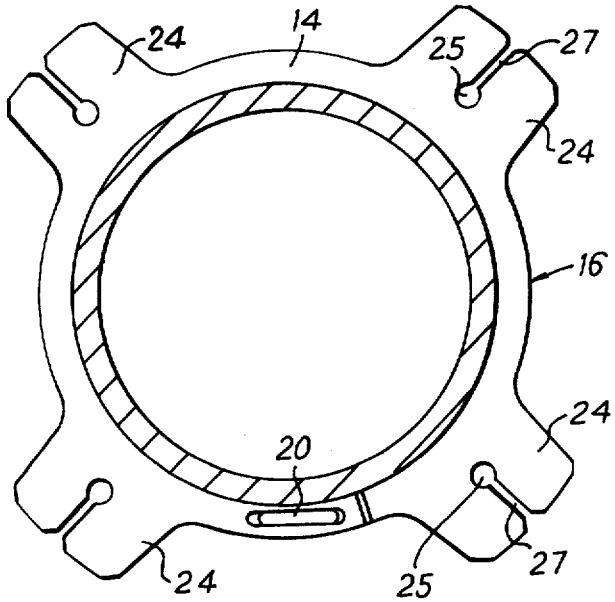
FIG. 4 is a plan view of the device of FIG. 3, installed on the flow tubing.
Figure 9:
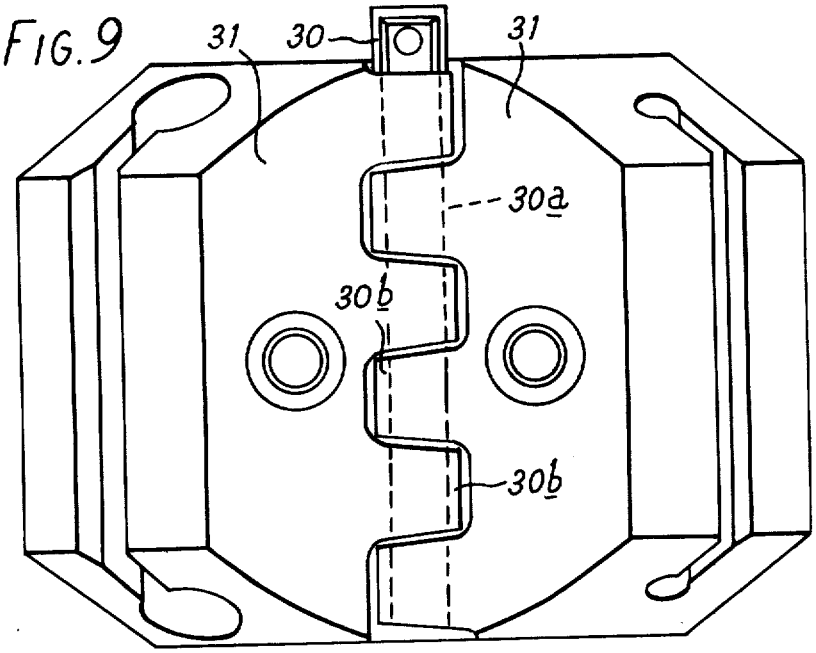
FIG. 9 is a side elevation of a third embodiment of positioning device.
Figure 12:
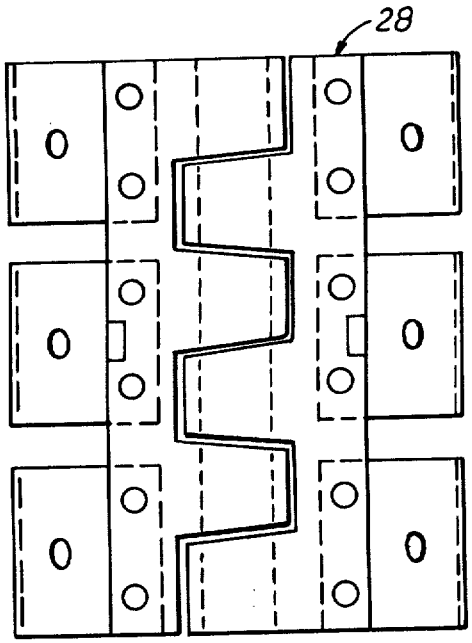
FIG. 12 is a side elevation of a metal cage incorporated in the device of FIG. 9.
Figure 10:
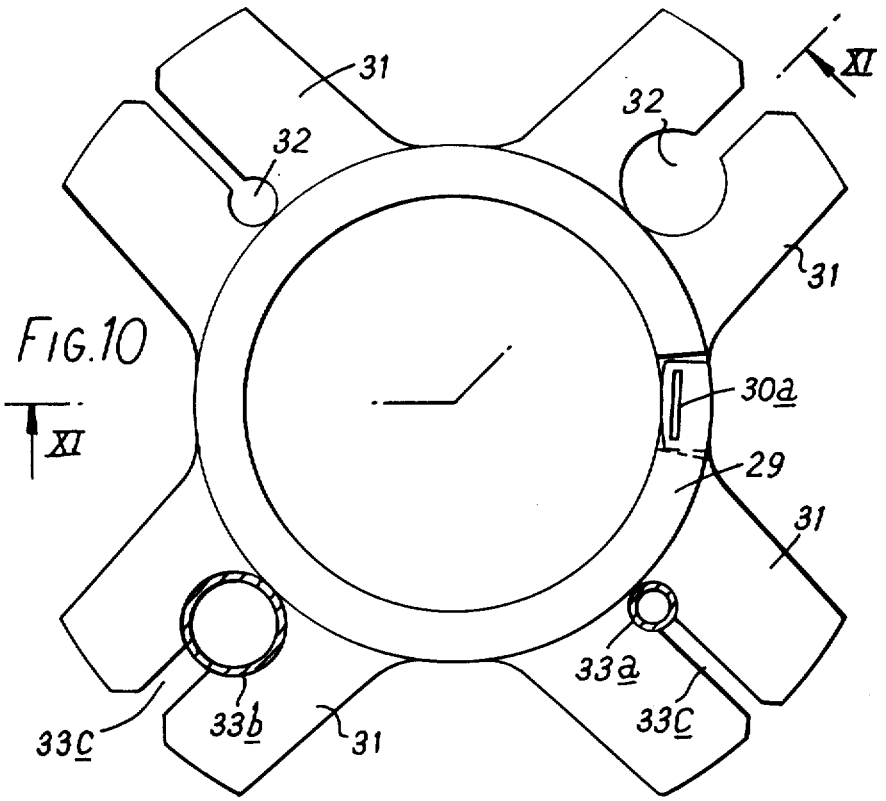
FIG. 10 is a plan view of the positioning device of FIG. 9.
Figure 11:
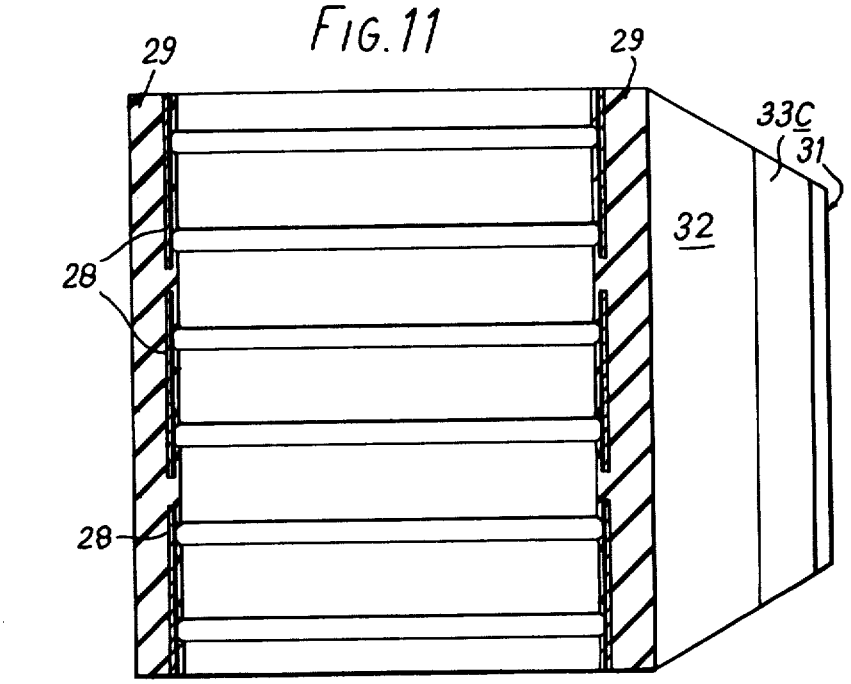
FIG. 11 is an axial section taken on the line XI—XI of FIG. 10.

Referring to FIGS. 1 and 2, a positioning device 1 comprises two similar half bodies 2, 3 each of which has a part-cylindrical internal face to embrace the wall of a flow tubing 4. Each half body includes two radial ribs 5 and the arrangement of the ribs is symmetrical at 90° intervals about the axis of the assembled device. At each longitudinal side edge, each half body has a set of axially-spaced circumferential fingers 6, and the fingers of each half body engage into the spaces between the fingers of the other half body. Each finger 6 includes a circumferentially elongated slot 7, and the slots 7 are wholly aligned radially, but only partially aligned circumferentially. To retain the half bodies in assembly there are provided two wedge-shaped locking pins 8 which are inserted from the top end and are driven into the slots 7 to tighten the half bodies 2, 3 about the flow tubing 4.

In each of the ribs 5 there is provided an opening 9 extending for the whole length of the rib, and the diameter of the opening 9 is preferably not greater than the diameter of a hydraulic control line tube 10 to be retained therein. Each rib 5 also has a recess 11 of somewhat less width passing from the external face 12 of the rib inwards to the opening 9. The ribs, at least, of the half bodies 2, 3 are made of resiliently deformable material, e.g. a rubber-like material, and the control line tube 10 can accordingly be forced radially inwards through the passage 11 until seated in the opening 9, in which it is firmly but resiliently retained in place by the deformable material of the rib. The passage 11 and the opening 9 together constitute the recess referred to herein. The lips of the passage 11 are chamfered, as at 13, to assist insertion of the control line tube 10. The control line tube 10 may advantageously be forced into the passage 11 by use of a punch tool (not shown).

The positioning device can be pre-installed on the flow tubing, and has excellent gripping capability, and does not mark the flow tubing because the grip is exerted by the resiliently deformable material of the device.

The ribs 5 of the device extend sufficiently in the radial direction to hold the flow tubing 4 away from the internal surface of the usual lining pipe cemented in the well to protect the hydraulic control line tube 10.

Referring now to FIGS. 3 to 8, there is shown a second embodiment of positioning device which has a body 14 made as a single piece instead of the two half bodies of FIGS. 1 and 2.

The body is composed of a metal cage member 15 (see FIGS. 5 and 6) moulded within a rubber covering 16. The cage member 15 is composed of three part-circumferential bands 15*a*, 15*b*, 15*c* on each end of which there is secured by rivets 17 a respective locking member 18 which includes fingers 19 having slots 20 to receive a taper locking pin 21 (FIGS. 7 and 8).

On each locking member 18 there is provided a lug 22, and the rubber covering is omitted over the lugs so that a simple tool (not shown) similar to a large pair of pliers may be applied to the lugs to force the cage member 15 closed over a flow line pipe 23 to permit the locking pin 21 to be inserted.

The rubber covering 16 has four ribs 24 disposed at 90° intervals about its axis, and each rib has a recess including an elongated opening 25 to receive a control line tube 26 which is forced through an elongated passage 27 of somewhat less width.

Referring now to FIGS. 9 to 12 there is shown a third embodiment of positioning device which is generally similar in construction to that described in relation to FIGS. 3 to 8. It has a metal cage member 28 with a rubber covering 29, and can be locked in position about a flow tubing by means of a taper locking pin 30 engaged in slots 30*a* in fingers 30*b*. The rubber covering includes four ribs 31 and diametrically opposed pairs of ribs 31 have recesses including elongated openings 32 which are respectively of different diameters to receive control line tubes 33*a* and 33*b* of different diameters, inserted through respective passages 33*c* of somewhat less width.

Referring now to FIGS. 13 to 16, there is shown a fourth embodiment of positioning device the body of which is composed of a rubber covering 34 on a metal cage member which is identical in construction to that shown in FIG. 5, with the exception that it has the very approximately oval shape indicated by the broken line 35 in FIG. 13. The two circumferential ends of the body include fingers 36 with elongated slots 37 to receive a taper locking pin 38, see FIGS. 15 and 16.

The body of the device has its rubber covering 34 shaped to define two circular bores 39 and 40 to receive respective flow tubings 41 and 42. The body also includes two ribs 43 and 44 disposed at diametrically opposed positions and each including a recess comprising an elongated opening 45 to receive a control line tube 46 inserted through an elongated passage 47 of somewhat less width. The entire assembly is disposed within a well lining pipe 48.

It will be appreciated that, by suitable enlargement and shaping of the body, composed of a metal cage and a rubber covering, the body of the positioning device may be provided with three or more circular bores similar to the bores 39, 40, to receive a corresponding number of flow tubings. Further, more than two ribs 43 or 44 may be provided, and each rib 43 or 44 may have more than one elongated opening 45 with an associated elongated passage 47.

I claim:

1. In a positioning device, for insertion in a space between a well lining pipe and flow tubing in said well lining pipe, having a body adapted to seat about said flow tubing, said body having an internal face to abut against the flow tubing and an external face remote from the internal face, the improvement that said body includes at least one rib of a resiliently deformable material containing a recess which opens at said external face and is adapted to receive a control line tube by resilient deformation of said portion.

2. In a positioning device, as claimed in claim 1, said recess including an opening in which said control line tube can be seated, and a passage communicating with said opening and with said external face, said passage being, for at least part of its length, of a width less than the width of said opening.

3. In a positioning device, as claimed in claim 1, said body comprising a metal cage and a covering of resiliently deformable material about said cage.

4. In a positioning device, as claimed in claim 1, said body having a break in circumferential continuity, and locking means being provided for securing together the circumferential ends of said body at said break.

5. In a positioning device, as claimed in claim 1, said body being in a plurality of circumferentially separate parts, and locking means being provided for securing together the adjacent ends of neighbouring said parts.

6. In a positioning device, as claimed in claim 4, said locking means comprising slots in the circumferential ends of said body, and a taper pin for engagement in said slots.

7. In a positioning device, as claimed in claim 5, said locking means comprising slots in the circumferential ends of said parts, and a taper pin for engagement in said slots.

8. In a positioning device, as claimed in claim 6, said circumferential ends of said body having axially spaced fingers, the fingers of one such end being interspersed between the fingers of the other such end, said slots being formed in said fingers.

9. In a positioning device, as claimed in claim 7, said circumferential ends of said parts having axially spaced fingers, the fingers of one such end being interspersed between the fingers of an adjacent other such end, said slots being formed in said fingers.

* * * * *